US006237507B1

(12) United States Patent
Yanagisawa et al.

(10) Patent No.: US 6,237,507 B1
(45) **Date of Patent: *May 29, 2001**

(54) INFORMATION APPARATUS INSTALLING DESK

(75) Inventors: Ryozo Yanagisawa, Chiba-ken; Atsushi Tanaka, Yamato; Yuichiro Yoshimura, Kamakura; Katsuyuki Kobayashi, Yokohama; Masaki Tokioka, Fujisawa; Hajime Sato, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/645,568

(22) Filed: May 14, 1996

(30) Foreign Application Priority Data

May 15, 1995 (JP) ..... 7-115743

(51) Int. Cl.[7] ..... A47F 5/12
(52) U.S. Cl. ..... 108/3; 108/50.01
(58) Field of Search ..... 108/3, 1, 7, 6, 108/50.01, 33, 4, 8, 9, 50.02, 23; 312/194, 223.2, 223.3, 223.1, 21, 30, 328, 226, 227, 224; 248/917, 92, 422, 923, 918, 929

(56) References Cited

U.S. PATENT DOCUMENTS 409,153 * 8/1889 Kintz ..... 108/7
1,102,060 * 6/1914 Leach ..... 312/226 X
1,925,771 * 9/1933 Miller ..... 108/7
2,013,542 * 9/1935 Nordmark ..... 108/3
2,230,444 * 2/1941 Balster ..... 312/223.3
2,328,471 * 8/1943 Leffel ..... 108/23 X
2,628,147 * 2/1953 Berner ..... 108/3 X
2,639,541 * 5/1953 Le Tang ..... 108/7
2,742,336 * 4/1956 Holmberg ..... 108/3
2,977,712 * 4/1961 Carriere ..... 108/3
3,095,833 * 7/1963 Peter ..... 108/3
4,304,447 * 12/1981 Ellwood et al. ..... 312/227 X
4,431,239 * 2/1984 Vainikka ..... 108/1 X
4,640,199 * 2/1987 Zigman ..... 108/7 X
5,101,736 * 4/1992 Bommarito et al. ..... 108/7
5,197,393 * 3/1993 Yeakle ..... 108/7 X
5,375,536 * 12/1994 Peters ..... 108/50 X
5,452,951 * 9/1995 Peller ..... 108/6 X
5,456,468 * 10/1995 Strinfellow et al. ..... 312/223.3 X

* cited by examiner

*Primary Examiner*—Jose V. Chen
(74) *Attorney, Agent, or Firm*—Fitzpatrick, Cella, Harper & Scinto

(57) ABSTRACT

An information apparatus has an input device with a portion to be supported in an information apparatus installing desk. The portion to be supported serves as a contact with an arc-shaped desk in which one point on a ridge line of a casing of the information apparatus is set to a center. A top plate having a concavity which can enclose an information apparatus, an arc-shaped receiving portion for supporting the arc-shaped portion to be supported, and a tilt mechanism for rotating the information apparatus around the center of the arc as a rotational center are provided on the desk side for installing the information apparatus.

17 Claims, 13 Drawing Sheets

INFORMATION APPARATUS INSTALLING DESK

BACKGROUND OF THE INVENTION

1. Field of the Invention

The invention relates to an information apparatus installing desk in which by allowing a pen-shaped or mouse-shaped coordinate indicator or a finger or the like to face an input surface, coordinate input means for detecting coordinates of a position of the coordinate indicator, finger, or the like and display means such as a liquid crystal display (LCD) or the like are integratedly constructed.

2. Related Background Art

In recent years, in an information apparatus as mentioned above, namely, in a computer, a word processor, a facsimile apparatus, or the like (hereinafter, generally referred to as a computer), or their terminal equipment, there has been devised and manufactured an information apparatus for executing various kinds of operations by integratedly constructing the coordinate input means and display means and by inputting by using a pen-shaped or mouse-shaped coordinate indicator or by a finger because of the improvement of a performance of a computer such as CPU, memory, or the like, the advancement of a software technique such as OS, application, or the like, the progress of a technique of a digitizer or a tablet, the progress of a flat panel display technique represented by an LCD, the progresses of various manufacturing techniques, and the like.

The above information apparatuses are generally classified into several types depending on their shapes. Schematic constructions of the above various types will now be shown and described hereinbelow.

A computer called a desk-top type is constructed by a main body having therein a CPU, a memory, and the like, a monitor comprising a CRT, a keyboard, a mouse, and the like. As a part of them, there is also a computer in which a main body and a monitor are integratedly constructed. A transparent tablet which is so called a resistive film system (or pressure sensitive system) is provided for the front surface of a display surface of the monitor. The tablet of the resistive film system has a construction such that two glass plates or resin films having transparent resistors are overlaid with a predetermined gap by making the resistor surfaces face each other. By depressing by a pen, finger, or the like, the two resistors come into contact with each other. A ratio between currents flowing in the resistors is obtained while using a contact point as an electrode, thereby detecting the coordinates of a position of the pen, finger, or the like.

A computer of a lap-top type, book type, or notebook type has an almost rectangular parallelepiped casing and is constructed in a manner such that a lower casing which has therein a CPU, a memory, a keyboard, and the like and an upper casing having display means of a flat panel such as LCD, plasma display (PDP), or the like can be freely opened and closed like a double-spread page. Coordinate input means is provided on the front or rear surface of the display means. As such coordinate input means, any one of various systems such as resistive film system, electromagnetic inductive system, electrostatic capacitor coupling system, ultrasonic wave using system, and the like can be used. According to the electromagnetic inductive system, the coordinate input means is made of one or two or more glass or resin plates each having loop-coil-shaped transparent electrode patterns in the X and Y directions. The coordinates of the position of the coordinate indicator are detected by the coupling of a magnetic field between the electrode and a coil provided for the pen-shaped or mouse-shaped coordinate indicator. According to the electrostatic capacitor coupling system, the coordinate input means is made of one or two or more glass or resin plates each having line-shaped transparent electrode patterns in the X and Y directions. The coordinates of the position are detected by an electrostatic coupling between the electrode and the coordinate indicator. According to the ultrasonic wave using system, by detecting a vibration which is propagated in an input plate, the coordinates of the position of the coordinate indicator are detected.

A computer of a pen-input type has an almost rectangular parallelepiped casing and a CPU, a memory, display means of a flat panel, and the like are provided in the casing. The coordinate input means is provided on the front or rear surface of the display means. The coordinate input means uses any one of various systems such as resistive film system, electromagnetic inductive system, electrostatic capacitor coupling system, ultrasonic wave using system, and the like.

The tablet as a computer terminal which is constructed by only the input means and display means also has an almost rectangular parallelepiped casing in a manner similar to the computer of the pen-input type mentioned above.

There is a desk for a television conference system which is so called an information apparatus installing desk in which the computer or tablet is installed as mentioned above. Such a desk is installed in a conference room or the like and the above computer or tablet is provided on the top plate surface with a predetermined inclination.

The operations of the information apparatus and information apparatus installing desk with the above construction will now be described. When the operator allows the coordinate indicator or his finger to approach or come into contact with the input surface, coordinates of the position of the coordinate indicator or finger, namely, an input point is detected by the coordinate input means and is outputted from the coordinate input means to the CPU. On the basis of an output result of the position coordinates of the input point, the CPU executes a predetermined function, for example, a menu command or the like. By a driving circuit of the display means, the point corresponding to the position of the indicator or finger can be also displayed by the display means. When the input is continuously performed by the indicator or finger, by connecting a group of input points detected at a predetermined sampling rate by a line, a locus of the operation of the indicator or finger can be displayed on the display means. Further, by discriminating and judging the locus, a recognition of a character or a figure, an execution of a gesture command, or the like can be performed. Moreover, various data can be communicated among a plurality of information apparatuses through a predetermined communication network.

The conventional information apparatus constructed as mentioned above has the following problems.

The desk-top type information apparatus generally has a monitor of a size in a range from about 10 to 20 inches as a diagonal line and is put on the desk and is used. Therefore, a space that is occupied by such an apparatus on the desk is extremely large. If the computer main body and a keyboard, a mouse, or an auxiliary memory device are also included, they occupy an area in a range from almost half to the entire surface of the top plate of each desk which has dimensions of a width of about 1200 to 1500 mm and a depth of about 700 mm and is used in various ordinary offices. In a special case, an exclusive-use desk has to be prepared to install the computer. In the works using the information apparatus as mentioned above, only the information apparatus is not always merely used but an original, resources, a manual, or the like is also used. When almost of the space on the desk is occupied by the information apparatus, there is problem such that a working efficiency is extremely bad. There is also a problem such that it is difficult to execute other tasks which are performed on the desk without using the information apparatus. It will be obviously understood that in case of the exclusive-use desk of the computer works, there are problems such that a space to install such an exclusive-use desk is needed and the operator needs to go to the exclusive-use desk each time he executes work and a working efficiency is extremely bad. In the desk-top type, in case of inputting by using the pen or finger, since such an inputting operation is executed to the input surface (also display surface) that is almost perpendicular to the surface of the top plate of the desk, there are problems such that the working performance is extremely unnatural and a burden is imposed on the operator it is remarkably difficult to execute the works for a long time.

The lap-top type has a flat panel display of about 10 inches as a diagonal line and its casing has dimensions of a width of about 300 mm and a depth of about 400 mm. There are problems such that a space occupied on the desk surface is large and such a large size obstructs the other works. Although the casing can be also vertically enclosed in order to assure a space for executing the other works, there are problems such that if the casing of a weight of a few kilograms is moved, installed, and enclosed on the desk each time it is used, a working performance is bad and a burden is imposed on the operator.

The book/notebook type has a flat panel display of about 10 inches or less as a diagonal line and is more advantageous as compared with the above two types in terms of the occupation space or enclosing space and also has a portability. However, since the size of input and display screen or keyboard is limited to a small size, there is a problem such that an operability including a visibility (way of seeing and easiness in looking of the screen) or a working performance is bad.

In the lap-top type and book/notebook type, the inputting operation by the pen or finger needs to be performed to the input and display screen in a double-spread page state while striding over the keyboard, so that operability is remarkably bad. In order to improve the operability, for example, as shown in JP-B-7-19186, there is also an apparatus constructed in a manner such that the input and display screen portion is swung so as to be located over the keyboard. In the above construction, however, since there are a thickness of the keyboard portion and thicknesses of the digitizer or tablet and the flat panel display unit, a level difference of tens of millimeters occurs between the input surface and the upper surface of the desk. The operator cannot stably put his hands or elbows onto the input surface or desk top surface. Dissatisfaction still remains in the operability.

The pen input type has a flat panel display of about 10 inches or less as a diagonal line. As an external shape of the casing, there are various sizes in a range from a small size to the A4 size. The pen input type is advantageous from a viewpoint of the occupation space or enclosing space and also has a portability. However, a size of input and display screen is further limited to a small size than that of the book/notebook type, so that there is a problem such that the operability including a visibility (way of seeing and easiness in looking of the screen) or a working efficiency is bad. On the other hand, since the CPU, memory, flat panel display, digitizer, and the like are provided in the casing, the casing has a thickness of tens of millimeters. Because of such a thickness, there is also a problem such that the operator cannot stably put his hands or elbows onto the input surface or desk top surface and the operability is bad.

The tablet as a computer terminal which is constructed by only the input means and display means also has a size similar to that of the pen input type and its visibility (way of seeing and easiness in looking of the screen) or working efficiency is bad. In a manner similar to the pen input type, there is also a problem such that the operator cannot stably put his hands or elbows onto the input surface or desk top surface because of a thickness of a certain degree such as to cause the operability of the casing deteriorate.

The desk for a television conference system in which the information apparatus is installed is a desk constructed only for use of a conference and nothing is considered with respect to an enclosing performance and a portability of the information apparatus installed. Since the oblique surface of the information apparatus is always fixedly positioned on the top plate surface, there is a problem such that it is extremely difficult to execute the other works.

SUMMARY OF THE INVENTION

The invention is made in consideration of the above problems and it is an object of the invention to provide a portable information apparatus installing desk in which a working space and an enclosing space are efficiently provided as saving spaces and an extremely excellent operability is obtained.

According to the invention, there is provided an information apparatus installing desk comprising: an information apparatus having an arc-shaped portion around a ridge line of a casing as a center and input means; a top plate having a concave portion which can enclose the information apparatus; and a tilt mechanism for rotating the information apparatus around the center of the arc-shaped portion as a rotational center by using the arc-shaped portion, wherein even if the information apparatus is tilted at a desired angle, no level difference occurs between the input surface and the desk top surface on the operator side and a good operability is obtained. The information apparatus can be easily attached and removed to/from the desk.

According to the invention, by setting the rotational center to a position near the concave portion, the position of the information apparatus when the information apparatus is tilted to a desired angle can be set to a position nearer to the operator side and the operability can be improved.

According to the invention, by setting the center of the arc-shaped portion onto a ridge line on the input surface side of the input means, the operability when the information apparatus is tilted to a desired angle can be improved.

According to the invention, by providing a second information apparatus for the information apparatus installing desk, a weight of information apparatus to be tilted can be lightened and the second information apparatus can be easily attached and removed.

According to the invention, the tilt mechanism comprises an arc-shaped receiving portion provided for the desk to support the arc-shaped portion; and a slide mechanism for vertically moving the bottom surface of the information apparatus. Thus, the good operability is obtained and the information apparatus can be easily attached and removed.

According to the invention, since the tilt mechanism has a rotating mechanism using a virtual axis as a center in place of the slide mechanism, good operability is obtained and the information apparatus can be easily attached and removed.

According to the invention, since the tilt mechanism has a cam portion using the ridge line as a center, good operability is obtained and the information apparatus can be easily attached and removed.

According to the invention, since the tilt mechanism has a cam portion using the ridge line as a center, the operability can be improved even when the information apparatus is tilted to a desired angle.

According to the invention, a connection port of an electric cord for connecting the information apparatus to the outside is provided in a bottom portion of the information apparatus, so that the attachment and removal and complicated wiring of the cords can be made unnecessary irrespective of the operations for attaching, detaching, and tilting the information apparatus.

According to the invention, by providing output means in place of the input means, the information apparatus having the output means can be easily tilted to a desired angle.

According to the invention, by further providing the output means for the information apparatus, the information apparatus for inputting and outputting can be tilted to a desired angle, so that the operability can be improved.

According to the invention, as an enclosing portion of the information apparatus, by providing a hole in the top plate in place of the concave portion, the top plate can be set to a simple structure and a weight can be lightened.

According to the invention, by providing an information apparatus with information input means and a portion to be supported which has an arc-like shape around one point on a ridge line of the casing of the information apparatus as a center and is used when the information apparatus is installed, the information apparatus can be tilted to a desired angle at which a good operability is obtained and can be operated and the information apparatus can be easily attached and removed to/from the desk.

According to the invention, there is provided the information apparatus installing desk comprising: a top plate having a concave portion which can enclose an information apparatus; an arc-shaped supporting portion for supporting a portion to be supported of the information apparatus; and a tilt mechanism for rotating the information apparatus while setting the center of the arc of the supporting portion to a rotational center, wherein the information apparatus that is installed to the information apparatus installing desk can be tilted to a desired angle at which a good operability is obtained and can be operated and the information apparatus can be easily attached and removed to/from the desk.

According to the invention, by setting the center of the arc of the supporting portion onto the top plate, the operability when the information apparatus is tilted to a desired angle can be improved.

DETAILED DESCRIPTION OF THE PREFERRED EMBODIMENTS

FIGS. 1 to 9 show the first embodiment of an information apparatus and an information apparatus installing desk to which the invention is applied. A schematic construction will now be described.

Figure 1:
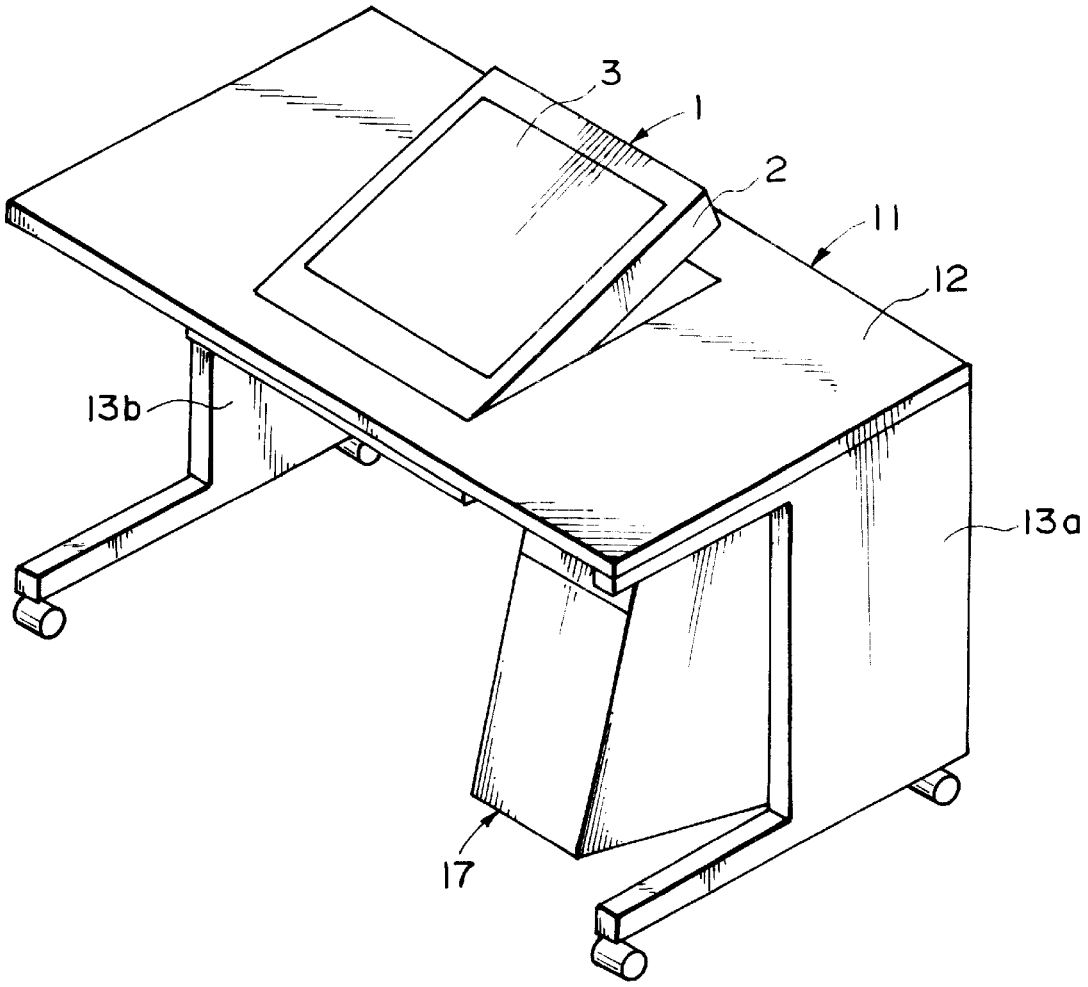
FIG. 1 is a schematic perspective view in a first state of an information apparatus in the first embodiment.
Figure 2:
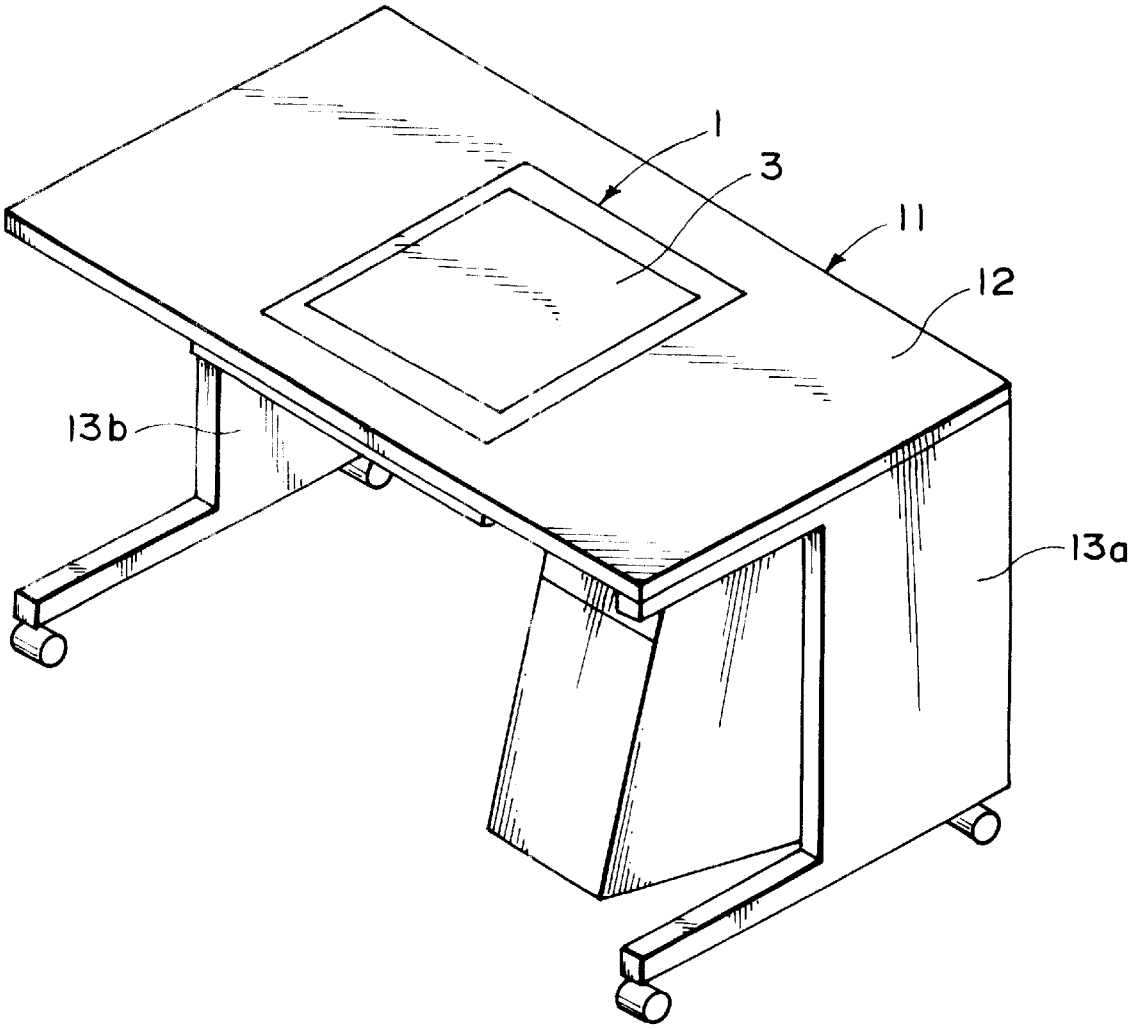
FIG. 2 is a schematic perspective view in a second state of the information apparatus in the first embodiment.
Figure 11:
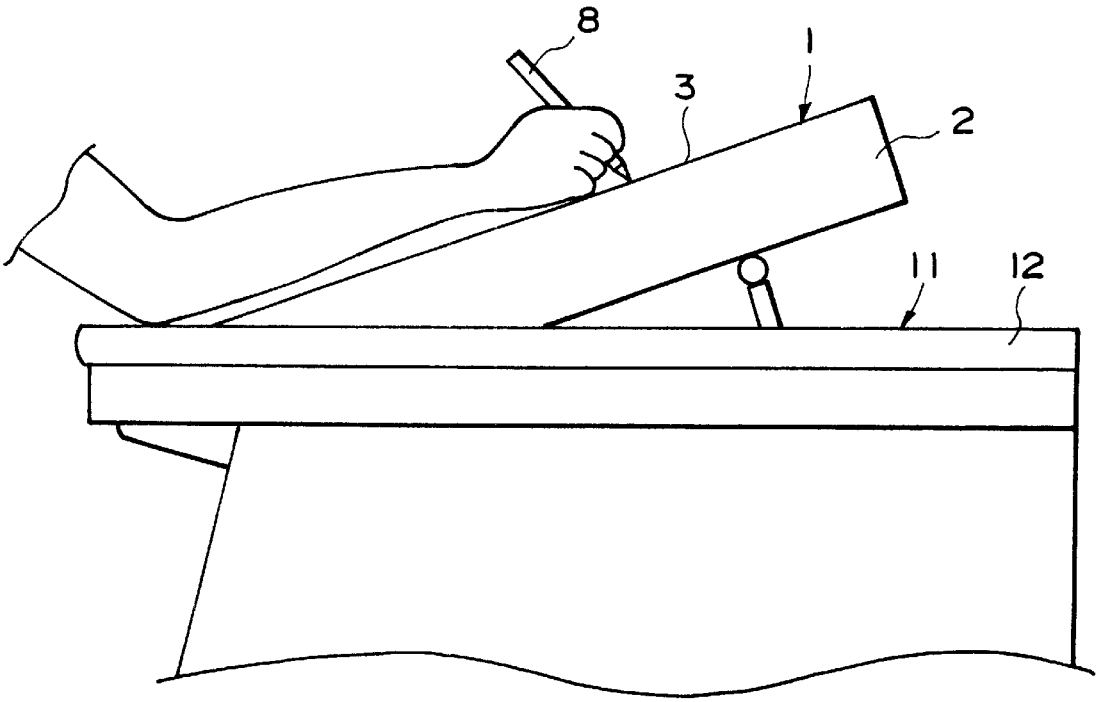
FIG. 11 is an explanatory diagram of a state at the time of an inputting operation in the first embodiment.

FIGS. 1 and 2 are perspective views of an information apparatus installing desk 11 in which an information apparatus 1 is installed. The information apparatus 1 can be operated in a state in which it is tilted to a desired angle as shown in FIG. 11 by a tilt mechanism built in the desk 11, which will be explained hereinlater. FIG. 1 shows a state in which the information apparatus 1 is projected from the desk 11 by the tilt mechanism and a predetermined angle is held. FIG. 2 shows a state in which the information apparatus 1 is enclosed in the desk 11.

Figure 3:
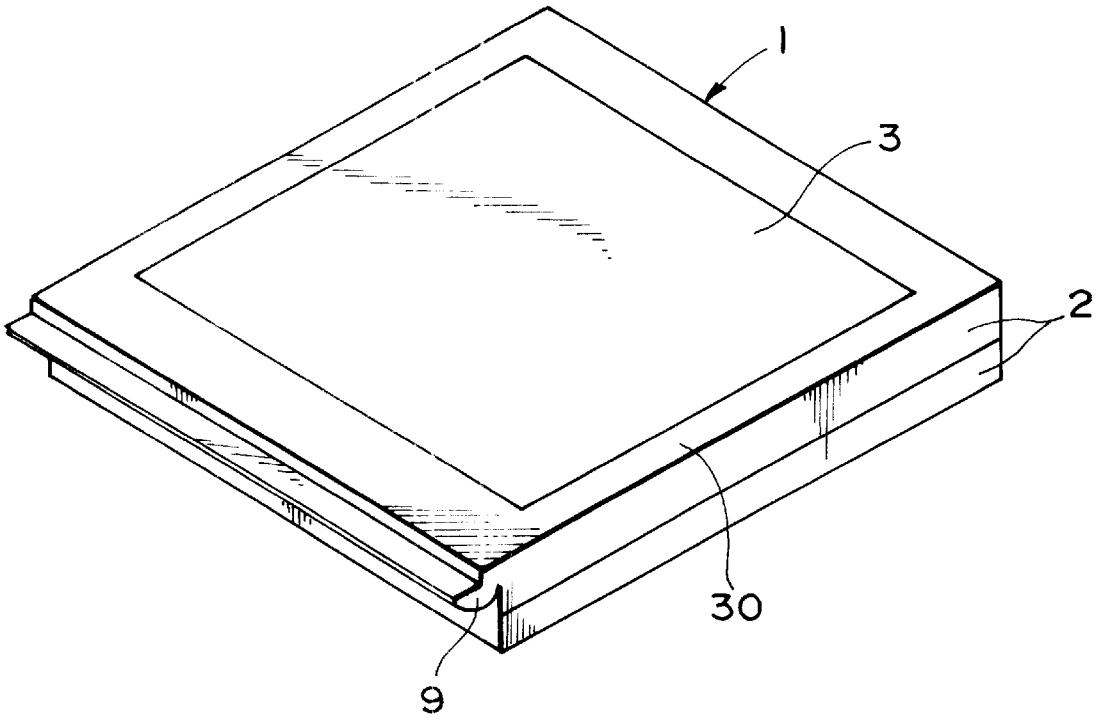
FIG. 3 is a schematic perspective view of an information apparatus 1 in the first embodiment.
Figure 4:
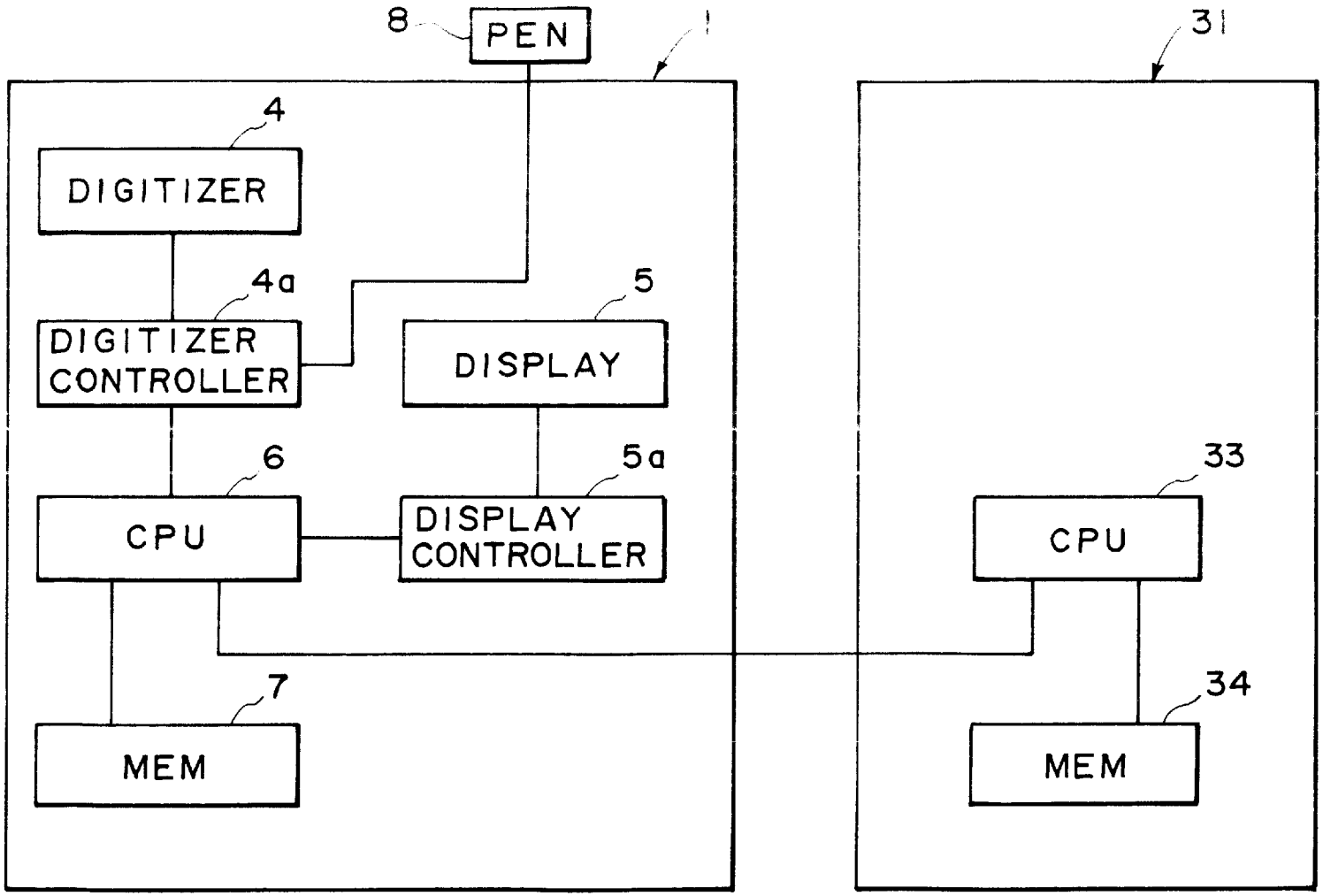
FIG. 4 is a block constructional view of the information apparatus in the first embodiment.

FIG. 3 shows an external view solely of the information apparatus 1. In the diagram, the information apparatus 1 comprises a casing 2 of an almost rectangular parallelepiped shape and has an input plate 3 of an almost rectangular shape on one surface. As also shown in a schematic block diagram of the information apparatus 1 of FIG. 4, a display 5 composed of an LCD and a printed circuit board are provided in the casing 2. Various circuits and circuit elements such as CPU 6 arranged under the display 5, various memories 7, digitizer controller 4*a*, display controller 5*a* as an LCD driver, inverter, DC—DC converter, various connectors, and the like are installed on the printed circuit board. The input plate 3 is a digitizer 4 of what is called a resistive film system. The input plate 3 has a structure such that a base plate made of glass or resin and a resin film are laminated with a predetermined gap. Resistive films are provided on surfaces of the base plate and resin film which face each other. By applying a voltage or current to each of them, a ratio between the voltages or currents or the like is measured for an input point which was pressurized by a pen 8, thereby detecting the coordinates of the position of the input point. An arc-shaped portion 9 whose center is positioned onto one ridge line 30 on the input surface side of the casing 2 is provided along the ridge line. The information apparatus 1 is constructed so that it can operate by a battery in a battery box (not shown) other than a power source from an AC adapter. As will be explained in detail hereinlater, reference numeral 31 denotes a computer main body for processing information that is inputted and outputted by the information apparatus 1.

Figure 5:
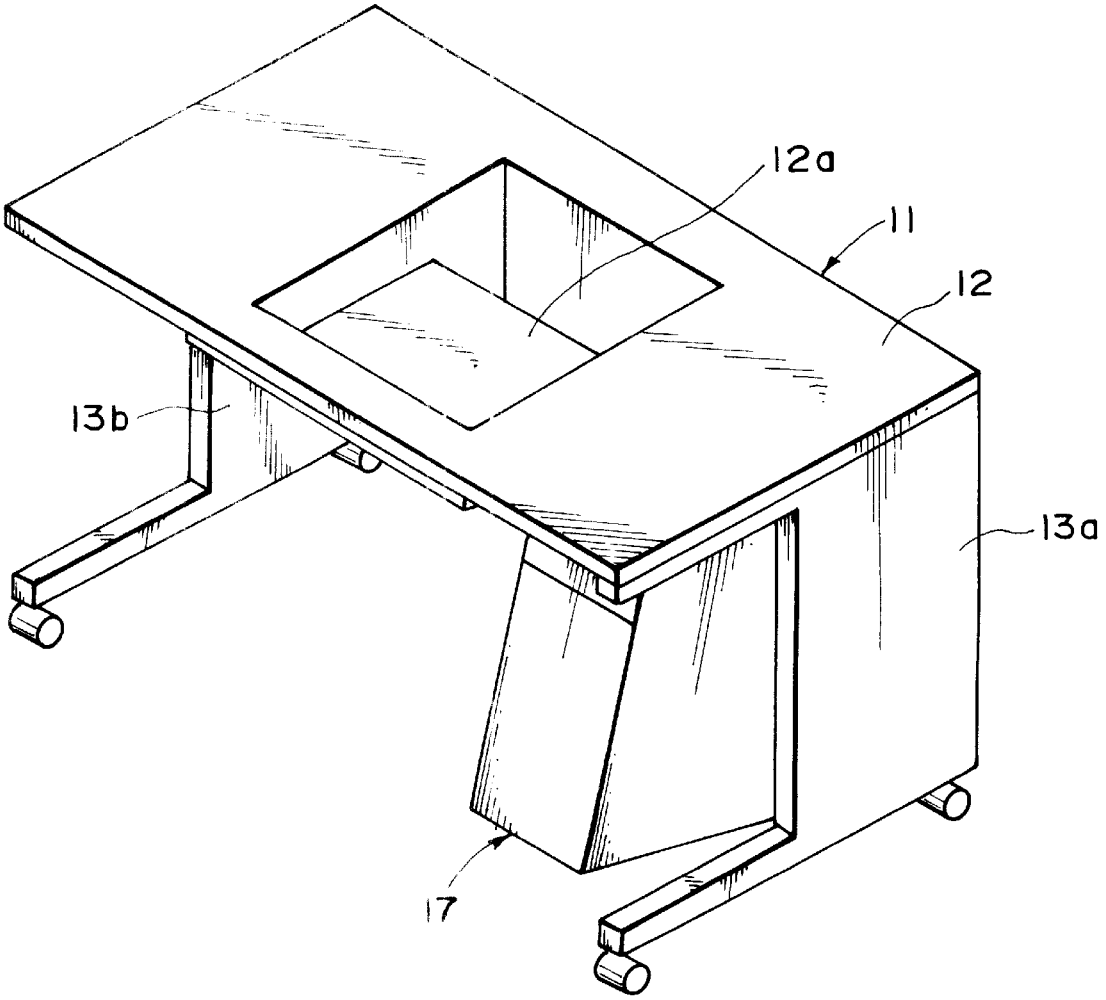
FIG. 5 is a schematic perspective view of an information apparatus installing desk 11 of the first embodiment.
Figure 6:
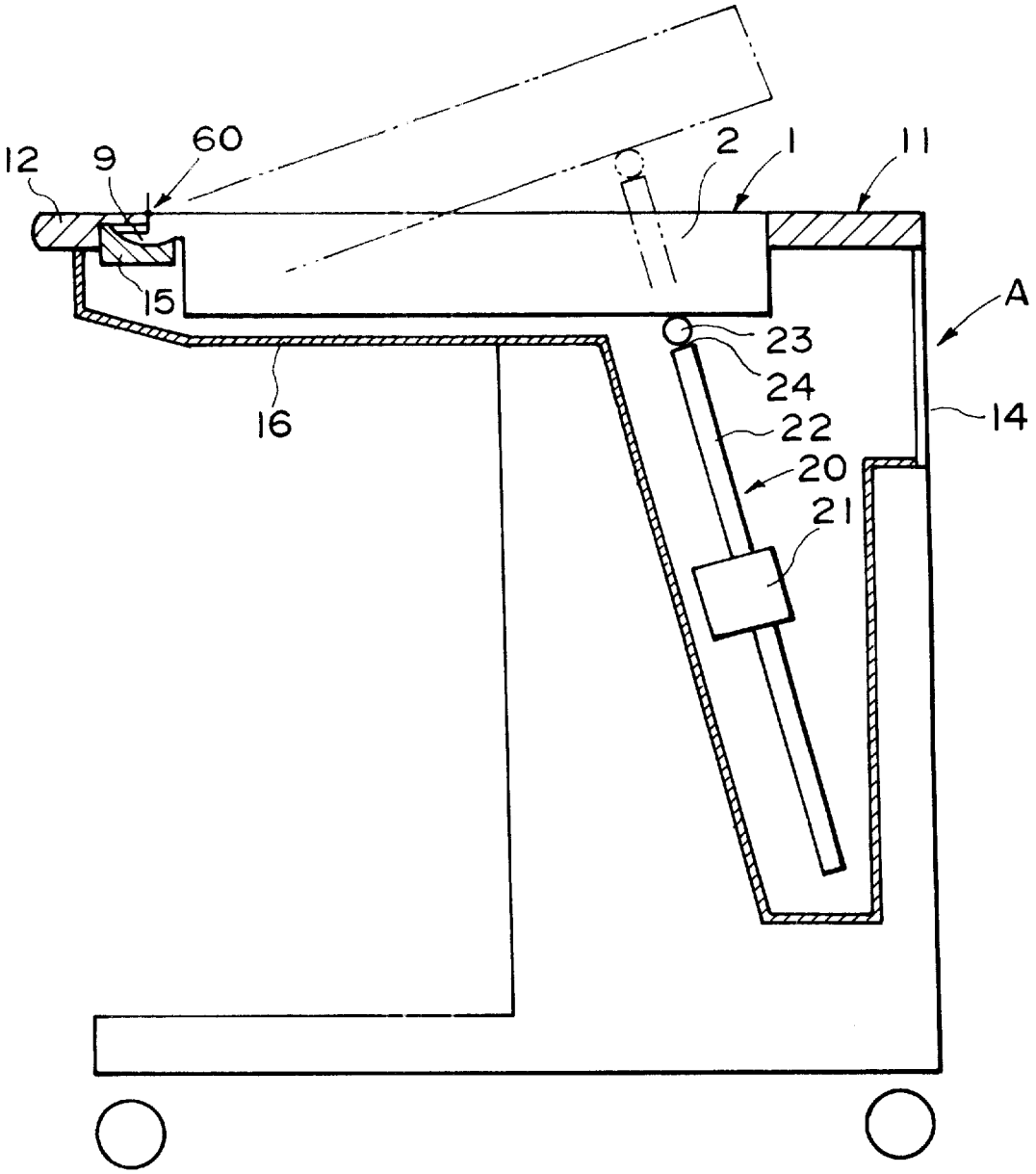
FIG. 6 is a schematic side sectional view of the first embodiment.
Figure 8:
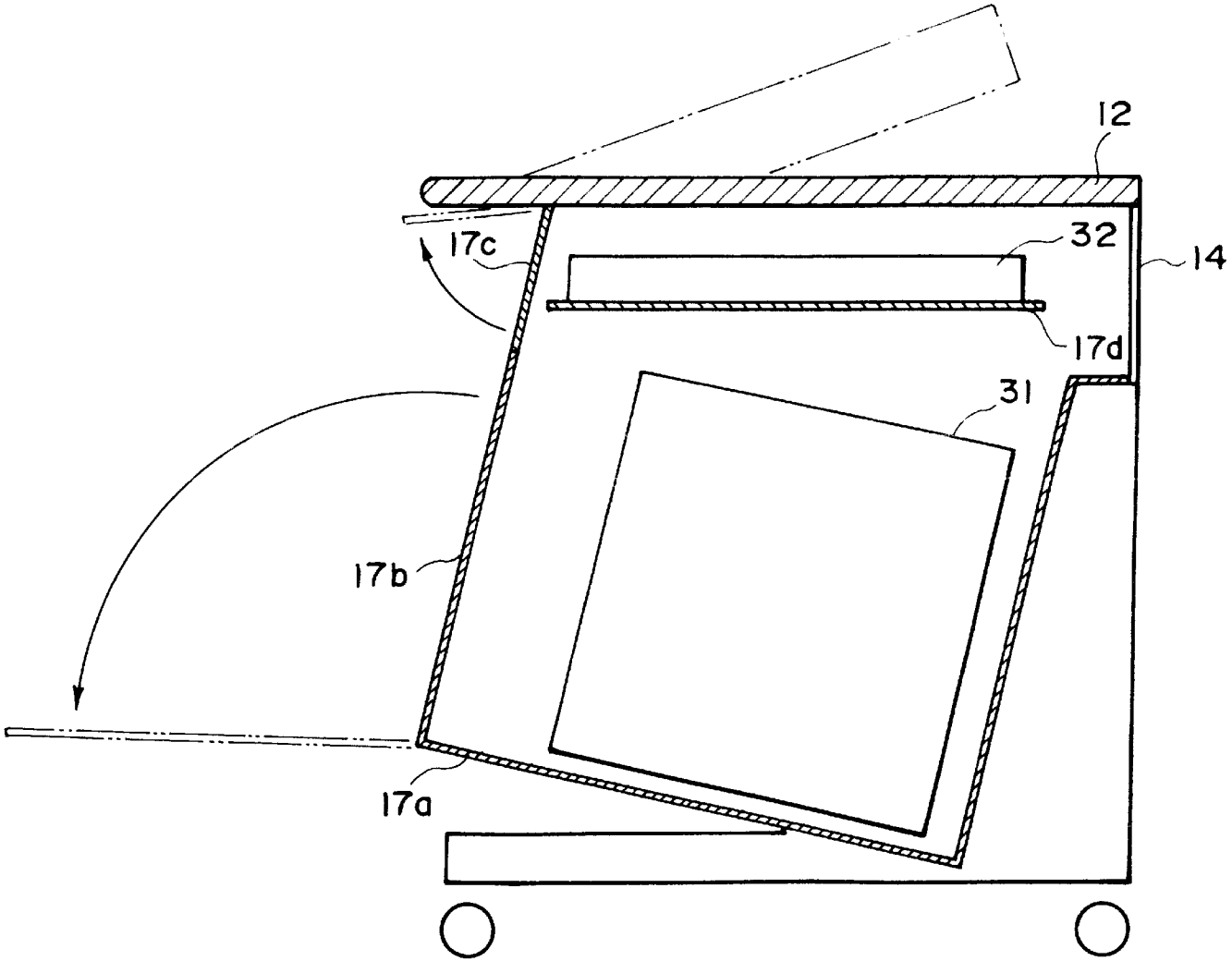
FIG. 8 is a schematic side sectional view of an enclosing box in the first embodiment.

FIG. 5 shows an external view of the desk 11. FIG. 6 shows a side sectional view of an information apparatus installing desk including the information apparatus 1. The desk 11 is constructed by a top plate 12 having a hole portion or concavity 12*a* in a center portion, right and left side plates 13*a* and 13*b*, and a rear plate 14. It will be obviously understood that reinforcing members (not shown) are provided as necessary. A tilt mechanism portion 20 is provided on the rear side under the top plate 12. A rear cover 16 is provided so as to cover the tilt mechanism portion 20 and hole portion 12*a*. An enclosing box 17 in which a desired apparatus can be installed is provided on the right lower side of the top plate 12. In the embodiment, the computer 31 which is so called a workstation in which a CPU of a higher speed and a memory of a larger capacity than those of the information apparatus 1 have been installed is installed in the enclosing box 17 as shown in FIG. 8. By connecting the information apparatus 1 to the computer 31, data of a larger amount can be handled at a higher speed. A structure of the enclosing box 17 will now be described with reference to the side sectional view of FIG. 8. A partition plate 17*d* is provided above the computer 31, thereby enabling a keyboard 32 and a mouse (not shown) to be enclosed on the partition plate 17*d*. Lids 17*b* and 17*c* which can be freely opened and closed to the front side are provided on the front surface of the enclosing box 17. By opening the lids 17*b* and 17*c*, the computer 31 or keyboard 32 and mouse can be inserted and taken out. An arc-shaped receiving portion 15 around a ridge line on the front side (operator side) of the hole portion 12*a* of the top plate 12 as a center is provided along the ridge line (FIG. 6). In FIG. 6, reference numeral 60 denotes a point set on the ridge line of the top plate 12. The casing 2 is rotated around a virtual axis represented by the point 60 as a rotational center. In order to realize such a rotation, the center of the arc of each of an arc-shaped portion 9 and the arc-shaped receiving portion 15 is set onto the rotational center point 60.

Figure 7:
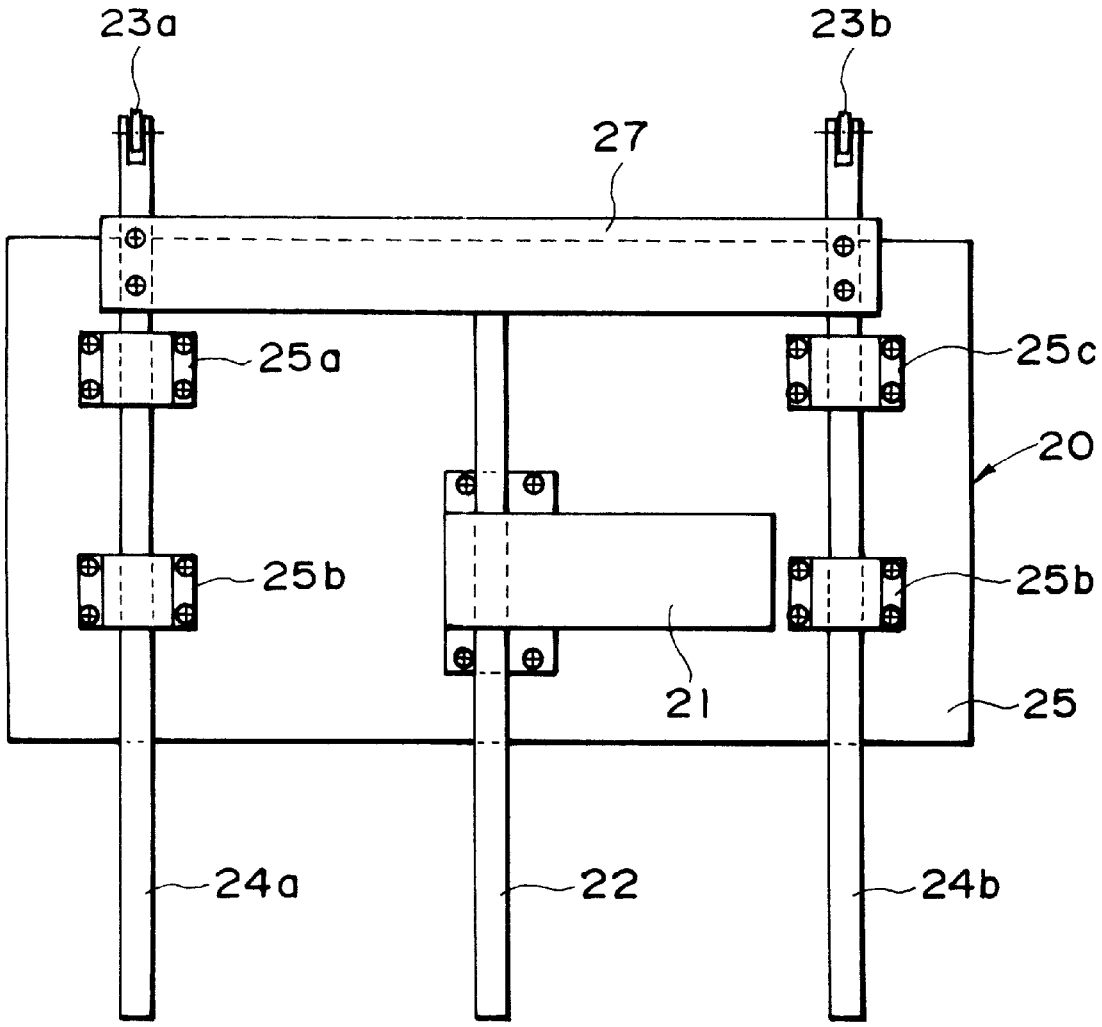
FIG. 7 is an explanatory diagram of a tilt mechanism portion in the first embodiment.

The tilt mechanism portion 20 will be further described. The tilt mechanism portion 20 has a slide mechanism for vertically moving a bottom portion of the information apparatus 1 installed in the desk 11. As shown in FIG. 6, the lower side of the tilt mechanism portion 20 is provided so as to be inclined to the rear side of the desk 11 so that it doesn't become an obstacle of the feet of the operator. FIG. 7 shows a schematic diagram of the tilt mechanism portion 20 when it is seen from the direction of an arrow A in FIG. 6. In the diagram, the tilt mechanism portion 20 is constructed by: a motor 21; a rack 22 which is slid by a pinion of the motor 21; slide axes 24*a* and 24*b* provided on the left and right sides of the rack 22; linear ball bearings and housings 25*a*, 25*b*, 25*c*, and 25*d* for guiding the slide axes 24*a* and 24*b*; roller bearings 23*a* and 23*b* provided in the tip portions of the slide axes 24*a* and 24*b*; a stay 27 fixed to the slide axes 24*a* and 24*b*; and a base plate 28 to attach the motor 21 and linear ball bearings and housings 25*a*, 25*b*, 25*c*, and 25*d*. In the above structure, by driving the motor 21, the rack 22 is vertically moved. When the rack 22 is moved upward, the tip of the rack 22 pushes up the stay 27, so that the slide axes 24*a* and 24*b* are slid upward together with the stay 27. The bottom portion of the information apparatus 1 which is supported by the roller bearings 23*a* and 23*b* is pushed up. When the rack 22 is moved downward by the operation of the motor 21, the stay 27 and slide axes 24*a* and 24*b* can enclose the information apparatus 1 into a state of FIG. 2 due to the own weights in accordance with the rack 22. In this instance, in the case where the information apparatus 1 has been installed in the desk 11, the information apparatus 1 traces the roller bearings 23*a* and 23*b* at the tips of the slide axes 24*a* and 24*b* due to the own weight and is tilted. In the above construction, an electromagnetic brake can be also provided for the motor 21 as necessary in order to hold the entire weight of the information apparatus 1, rack 22, slide axes 24*a* and 24*b*, and stay 27.

Figure 9:
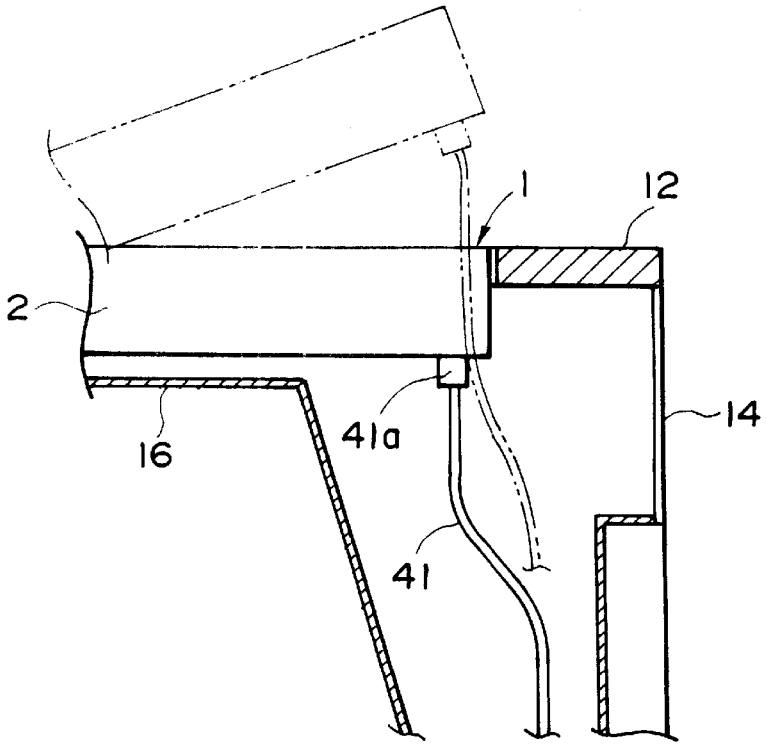
FIG. 9 is an explanatory diagram of a first example of a connecting cord portion in the first embodiment.
Figure 10:
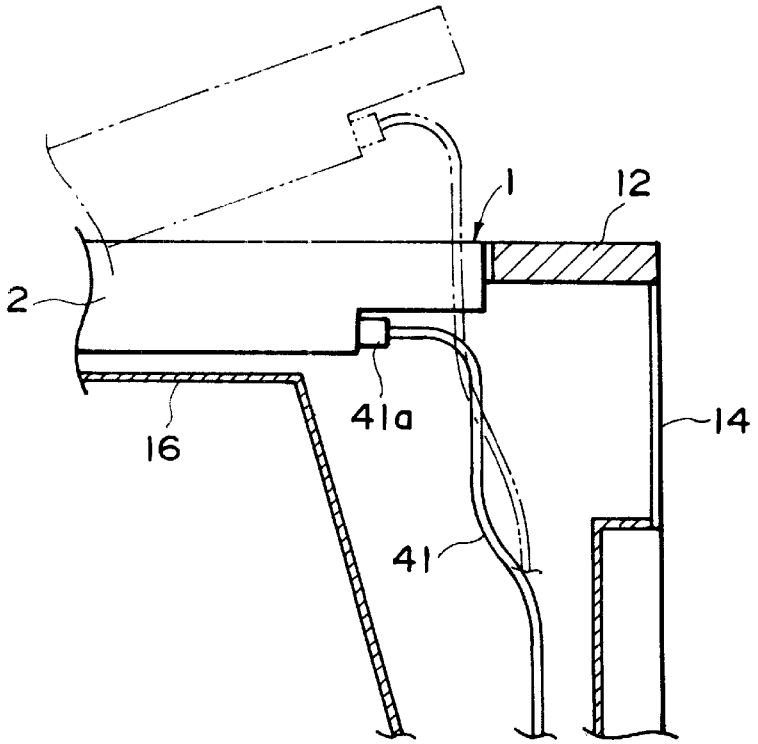
FIG. 10 is an explanatory diagram of a second example of the connecting cord portion in the first embodiment.

An arrangement of various cables for a network I/F or centronics I/F as connecting means for connecting the information apparatus 1 and the other information apparatuses including the computer 31 or connecting cords such as a power source cord and the like. As shown in FIG. 9, the above connection is performed by inserting connectors 41*a* of various connecting cords 41 into various ports provided on the bottom rear side of the information apparatus 1. By providing the connecting means for the bottom portion of the information apparatus 1 and by arranging the connecting cords 41 in the vertical downward direction due to the own weights, even if the information apparatus 1 is swung due to the tilt mechanism, trouble such that the connecting cords 41 are got twisted, pulled out, broken, disconnected, or the like doesn't occur and the construction with a high reliability can be realized. The arrangement of the connecting cords 41 is not limited to the above construction. As shown in FIG. 10, it is also possible to provide a stairway portion for the bottom portion of the information apparatus 1 and to provide various ports for the stairway portion, thereby enabling the connectors 41*a* to be inserted therein.

In the above construction, an attaching state of the information apparatus 1 to the desk 11 will now be described. When the information apparatus is attached, as shown in FIG. 6, the arc-shaped portion 9 of the information apparatus 1 is fitted and supported into the arc-shaped receiving portion 15 and the bottom portion of the casing 2 is supported by the roller bearings 23*a* and 23*b* at the tips of the slide axes 24*a* and 24*b*. The information apparatus 1 is positioned in the right and left directions for the desk 11 by both side surfaces of the casing 2 and both side surfaces of the hole portion 12*a* and is positioned in the depth direction by the arc-shaped portion 9 and arc-shaped receiving portion 15. The desk 11 is constructed in a manner such that when the apparatus is in a state shown in FIG. 2 and the rack 22 is located at the bottom end, the upper surface of the top plate 12 and the upper surface of the casing of the information apparatus 1 are set to almost the same plane.

The operation of the information apparatus 1 and information apparatus installing desk 11 with the above construction will now be described. By turning on a power switch (not shown) provided at a predetermined position where the user can operate, for example, on the front side or the like of the desk 11, currents are supplied to the information apparatus 1, computer 31, and motor 21. Subsequently, by turning on an elevation switch (not shown) provided at a predetermined position where the user can operate, for example, on the front side of the desk 11 or the like, the motor 21 is driven and the slide axes 24*a* and 24*b* are lifted up or down. A signal of the elevation switch is sent to the controller of the motor 21, thereby controlling the rotating direction of the motor 21, namely, the moving direction of the rack 22. As an elevation switch, it is also possible to use a switch with any one of the constructions such as two act switches, toggle switches, momentary switches, and the like. By the elevation of the slide axes 24*a* and 24*b*, the roller bearings 23*a* and 23*b* push up the bottom portion of the casing 2 and the information apparatus 1 is tilted upward. In association with the descent of the slide axes 24*a* and 24*b*, the information apparatus 1 traces the roller bearings 23*a* and 23*b* due to the own weight and is tilted downward. In the above tilt, the information apparatus 1 executes a rotating motion (rotation) around one point on a ridge line on the front side of the input surface of the casing 2 or a ridge line on the front side of the hole portion 12*a* as a center. Such a rotational center is called a virtual axis locating on the upper surface of the top plate 12. Since the information apparatus 1 executes a rotating motion around the virtual axis as a center, the upper surface of the casing 2 and the surface on the front side (operator side) than the virtual axis of the upper surface of the top plate 12 are coupled without a stairway portion irrespective of the tilt angle. Although the above construction has been shown and described so that the ridge line on the front side of the input surface of the casing 2 or the ridge line on the front side of the hole portion 12*a* coincides, actually, a predetermined gap is obviously provided between both of the ridge lines. It will be obviously understood that the desk is constructed so that the position of the arc-shaped portion 9 or arc-shaped receiving portion 15 is deviated by only a distance corresponding to the gap. Such a stairway portion occurs in a portion other than the construction of the invention and a way of occurrence of such a stairway portion differs depending on the position of the rotational center of the tilt. However, for example, assuming that the rotational center is located on the lower side of the upper surface of the top plate 12 on the rear side than the virtual axis, by tilting the apparatus, the ridge line on the front side of the input surface of the casing 2 sinks from the upper surface of the top plate 12, so that the stairway portion occurs. In the case where, for example, the rotational center is located on the lower side of the upper surface of the top plate 12 on the front side than the virtual axis, by tilting the apparatus, the ridge line on the front side of the input surface of the casing 2 is floated from the upper surface of the top plate 12, so that the stairway portion occurs.

By operating the tilt mechanism, the information apparatus 1 can be set to an angle suitable for each operator such that the operator can easily input to the input plate 3 serving as an input surface and also a display surface by using a pen or finger and can easily see the display surface. By allowing the pen or finger to come into contact with the input surface by the operator, the position coordinates are detected by the digitizer 4 and various functions, for example, the execution of a menu command and the like are executed. By displaying a locus of a continuous input by the pen or finger to the display means, various figures or pictures can be drawn. By discriminating the above locus, the recognition of a character or a figure, the execution of a gesture command, or the like can be performed.

When inputting by the pen or finger, good operability as one of the main objects of the invention is realized by the information apparatus 1 and desk 11. Namely, when inputting, although the information apparatus 1 can be obviously tilted to an angle at which the operator can easily input, even at any tilt angle, since there is no stairway portion between the upper surface of the casing 2 and the surface on the front side (operator side) than the virtual axis of the upper surface of the top plate 12, as shown in FIG. 11, the operator can extremely naturally put his elbows onto the upper surface of the top plate 12 or the upper surface of the casing 2. The operator can extremely naturally move the elbows in an interval between the upper surface of the top plate 12 and the upper surface of the casing 2. Further, the operator can remarkably naturally put his hands onto the upper surface of the casing 2 or the input plate 3. Thus, the arms can be stabilized and the smooth inputting operation can be executed for a long time. As shown in FIG. 3, by keeping a width around the input plate 3 for the casing 2, in the case where the hands are put onto the casing 2 in a posture as shown in FIG. 11, an erroneous inputting operation is not performed and good operability is obtained. By putting an original, references, a manual, or the like onto the top plate 12 on either the right or left side of the information apparatus 1, the operator can perform the inputting operation while referring to them as necessary.

Explanation will now be made with respect to the case where the information apparatus 1 is not used or the other work is executed on the top plate 12. In such a case, the information apparatus 1 is tilted downward by the tilt mechanism, the rack 22 is positioned to the bottom end, and the information apparatus 1 is enclosed into the desk 11. At this time, the upper surface of the top plate 12 and the upper surface of the casing 2 of the information apparatus 1 are set to an almost same plane. There is no need to provide a space for the information apparatus 1 onto the top plate 12. The operator can execute the other work as if he worked on an ordinary desk. When the information apparatus 1 is not used, if the operator wants to supply a current to any one of the information apparatus 1, computer 31, and tilt mechanism and to shut off the other power sources, each power switch is provided.

In case of using the keyboard 32 or mouse for inputting a large amount of data, subsequently, by taking out the keyboard 32 or mouse from the enclosing box 17 and putting it onto the top plate 12, the inputting work can be executed. In order to stably set the keyboard 32 onto the top plate 12 on the front side of the virtual axis, a receiving plate of a pull-out type, a lever of a rotary type, or the like is provided as necessary. Since the keyboard 32 or mouse can be enclosed into the enclosing box 17 when it is not used, when inputting by the pen or finger or when executing the other work, there is no limitation in space.

A portability of the information apparatus 1 as one of the main objects of the invention, namely, the attaching and removal of the information apparatus 1 to/from the desk 11 will now be described. First, the information apparatus 1 is elevated upward to a proper angle by the tilt mechanism (state of FIG. 6) and the connecting cords 41 are disconnected from the casing 2. Subsequently, the operator grasps the casing 2 of the information apparatus 1 and rotates the casing 2 to the front side around the virtual axis as a center. By pulling up the casing 2 upwardly or obliquely upwardly on the rear side when or before the upper surface (input surface) of the casing 2 is set to be vertical, the information apparatus 1 can be easily taken out from the desk 11. In case of attaching the information apparatus 1 to the desk 11, by executing the operation opposite to that mentioned above, the information apparatus 1 can be easily attached to the desk 11. The information apparatus 1 removed from the desk 11 by the above operation can be carried to another location such as a conference room or the like as necessary. When the operator is returned to the desk 11, by again attaching the information apparatus 1 to the desk 11 and connecting the connecting cords, the operator can execute various works on the desk 11. For example, the operator can perform the arrangement of data inputted at a location of the movement destination, high-speed data process using the computer 31, reference of various documents, and the like.

As described above, in the embodiment, since an inside dead space of the desk 11 is used as a portion to enclose and install the information apparatus 1, tilt mechanism portion 20, computer 31, keyboard 32, and mouse, when the information apparatus 1 is not used, there is no use to keep a space on the top plate 12 for the information apparatus 1, tilt mechanism portion 20, computer 31, keyboard 32, and mouse. Therefore, the space can be extremely efficiently used and saved. When the information apparatus 1 is enclosed, the whole region of the upper surface of the desk 11 is set to a flat surface. The other works can be smoothly performed on the desk 11.

Upon inputting, by tilting the information apparatus 1 to an angle at which the operator can easily input, the comfortable inputting work can be performed. Even at any tilt angle, since the upper surface of the casing 2 and the upper surface of the top plate 12 are coupled without a stairway portion, the elbows can be extremely naturally put on the upper surface of the top plate 12 or the upper surface of the casing 2. The elbows can be also remarkably naturally moved in a gap between the upper surface of the top plate 12 and the upper surface of the casing 2. Further, the hands can be also extremely naturally put onto the upper surface of the casing 2 or the input plate 3. Therefore, the information apparatus of an extremely good operability in which the arms can be stabilized and the inputting operation can be smoothly performed for a long time can be realized.

By constructing such that the information apparatus 1 is installed to the desk 11 by using the gravity, the information apparatus 1 can be easily attached and removed to/from the desk 11, so that the information apparatus 1 can have a portability. Since various kinds of maintenances can be performed in a state in which the information apparatus 1 is removed, those maintenances can be easily performed.

The size of the input and display screen of the information apparatus 1 of the invention is not limited but can be also set to various sizes in a range from a small screen of a few inches to a large screen of the size corresponding to the surface of the top plate. Particularly, by installing a display of about 20 inches, for example, a document of the A4 size can be displayed at an equal magnification. The information apparatus 1 with extremely good visibility and operability can be realized.

Other embodiments

In the above embodiment, although the information apparatus 1 has been installed to the desk 11, the invention is not limited to the above construction. It is also possible to construct such that the information apparatus is installed to another information apparatus. An embodiment with such a construction is shown in FIGS. 12 and 13.

Figure 12:
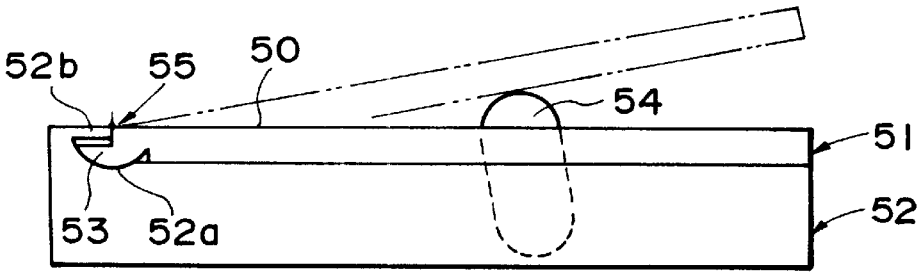
FIG. 12 is a schematic side elevational view of an information apparatus and another information apparatus according to another embodiment.
Figure 13:
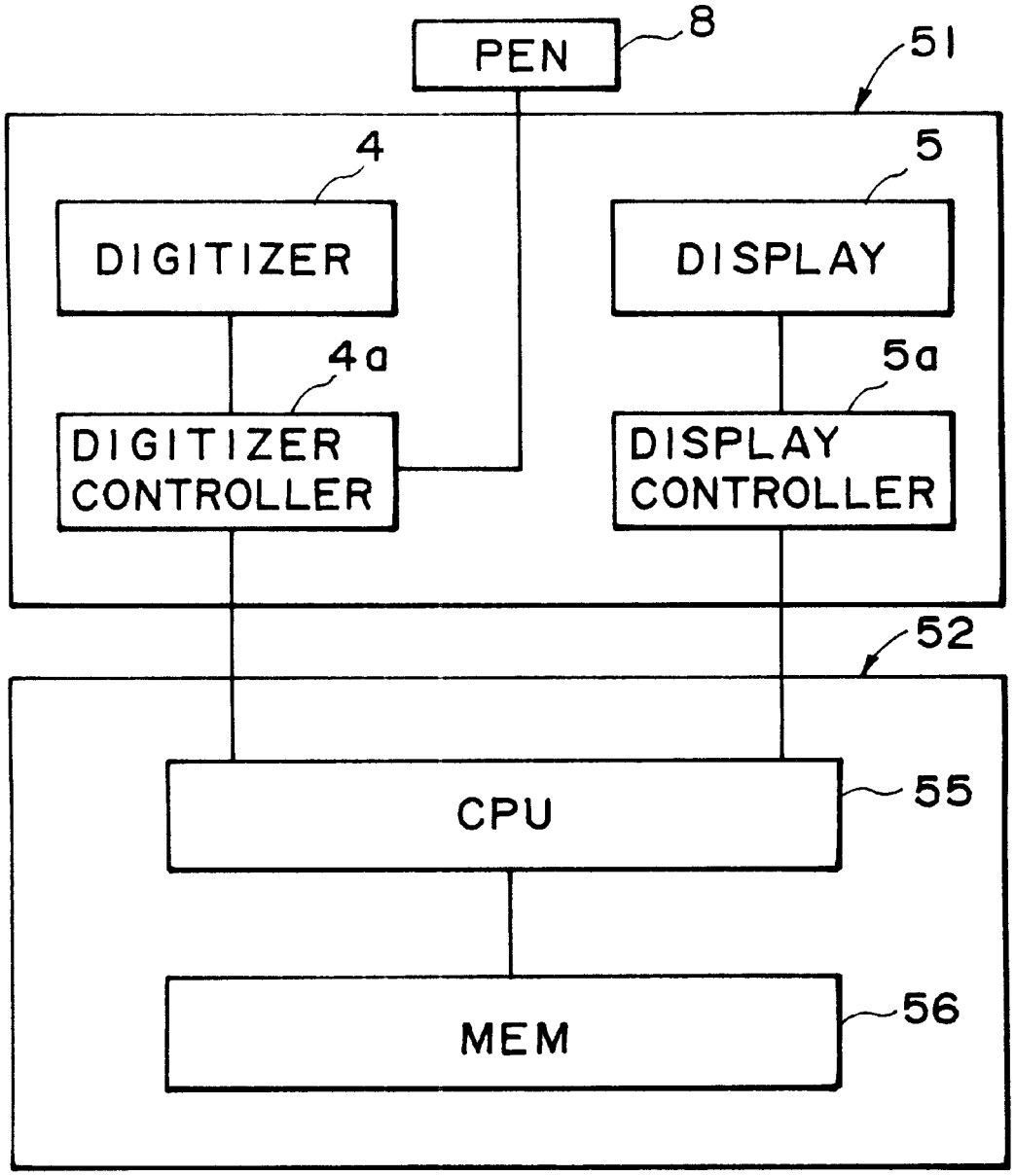
FIG. 13 is a block constructional diagram of an information apparatus 51 and another information apparatus 52 in another embodiment.

In FIG. 12, an information apparatus 51 is installed on another information apparatus 52. The information apparatus 51 has a casing of an almost rectangular parallelepiped shape and is what is called a terminal tablet which having an almost rectangular input surface on one surface and includes: the digitizer 4; display 5 consisting of an LCD arranged so as to be overlaid on the digitizer 4; digitizer controller 4*a*; and display controller 5*a*. An arc-shaped portion 53 in which one point (virtual axis) 55 on one ridge line 50 on the input surface side of the casing is set to a center is provided along the ridge line 50. The information apparatus 52 has a casing of an almost rectangular parallelepiped shape and a convex portion 52*b* is formed on the upper surface on the operator side. An arc-shaped receiving portion 52*a* in which a ridge line on the rear side of the convex portion 52*b* is set to a center is provided along the ridge line in the convex portion 52*b*. The information apparatus 52 is so called a computer main body having therein a CPU 55 and a memory 56. A cam roller 54 which is rotated by operating a lever (not shown) provided at a position where the user can operate is provided. The cam roller 54 is constructed in a manner such that when it is rotated, a cam surface is ejected from the upper surface of the casing of the information apparatus 52. The information apparatuses 51 and 52 are electrically connected by a flexible board provided between the bottom surface of the casing of the information apparatus 51 and the upper surface of the casing of the information apparatus 52. When the information apparatus 51 is installed to the information apparatus 52, the arc-shaped portion 53 of the information apparatus 51 is fitted and supported to the arc-shaped receiving portion 52*a* of the information apparatus 52. The positioning to the right and left is performed by providing a side surface for the arc-shaped portion 53 and a member which faces the side surface in the information apparatus 52. The positioning in the depth direction is performed by the arc-shaped portion 53 and arc-shaped receiving portion 52*a*. When the cam surface of the cam roller 54 lies in the casing of the information apparatus 52, the bottom surface of the information apparatus 51 comes into contact with the upper surface of the casing of the information apparatus 52 and the information apparatus 51 is supported. In this instance, the information apparatuses 51 and 52 are constructed in a manner such that the upper surface of the casing of the information apparatus 51 and the upper surface of the convex portion 52*b* of the information apparatus 52 are set to an almost same plane. By operating the foregoing lever, the cam roller 54 is rotated, so that the cam surface is protruded from the upper surface of the casing of the information apparatus 52 and the information apparatus 51 is tilted.

Even in the above construction, in a manner similar to the embodiment, even at any tilt angle, the information apparatus 51 is tilted around the virtual axis locating on the upper surface of the casing of the apparatus 51 as a center. Therefore, no stairway portion occurs between the upper surface of the casing of the information apparatus 51 and the upper surface of the convex portion 52*a* of the information apparatus 52. The operator can extremely naturally put the elbows onto the upper surface of the convex portion 52*a* or the upper surface of the casing of the information apparatus 51. The operator can also remarkably naturally move the elbows in an interval between the upper surface of the convex portion 52*a* and the upper surface of the casing of the information apparatus 51 and further can extremely naturally put the hands onto the upper surface of the casing of the information apparatus 51 or the input surface. Thus, the arms can be stabilized and the smooth inputting operation can be executed for a long time. Namely, even in the above construction, the information apparatus of an extremely good operability can be realized. By constructing so as to install the information apparatus 51 to the information apparatus 52 by using the gravity, the information apparatus 51 can be easily attached and removed to/from the information apparatus 52. The information apparatus 51 has a portability. In a state in which the information apparatus 51 is removed, various maintenances of the information apparatus 51 can be easily performed.

In the above construction, it will be obviously understood that the information apparatus 51 is not limited to the terminal tablet but may be also what is called a pen input computer in which a CPU, a memory, and the like are installed.

Figure 14:
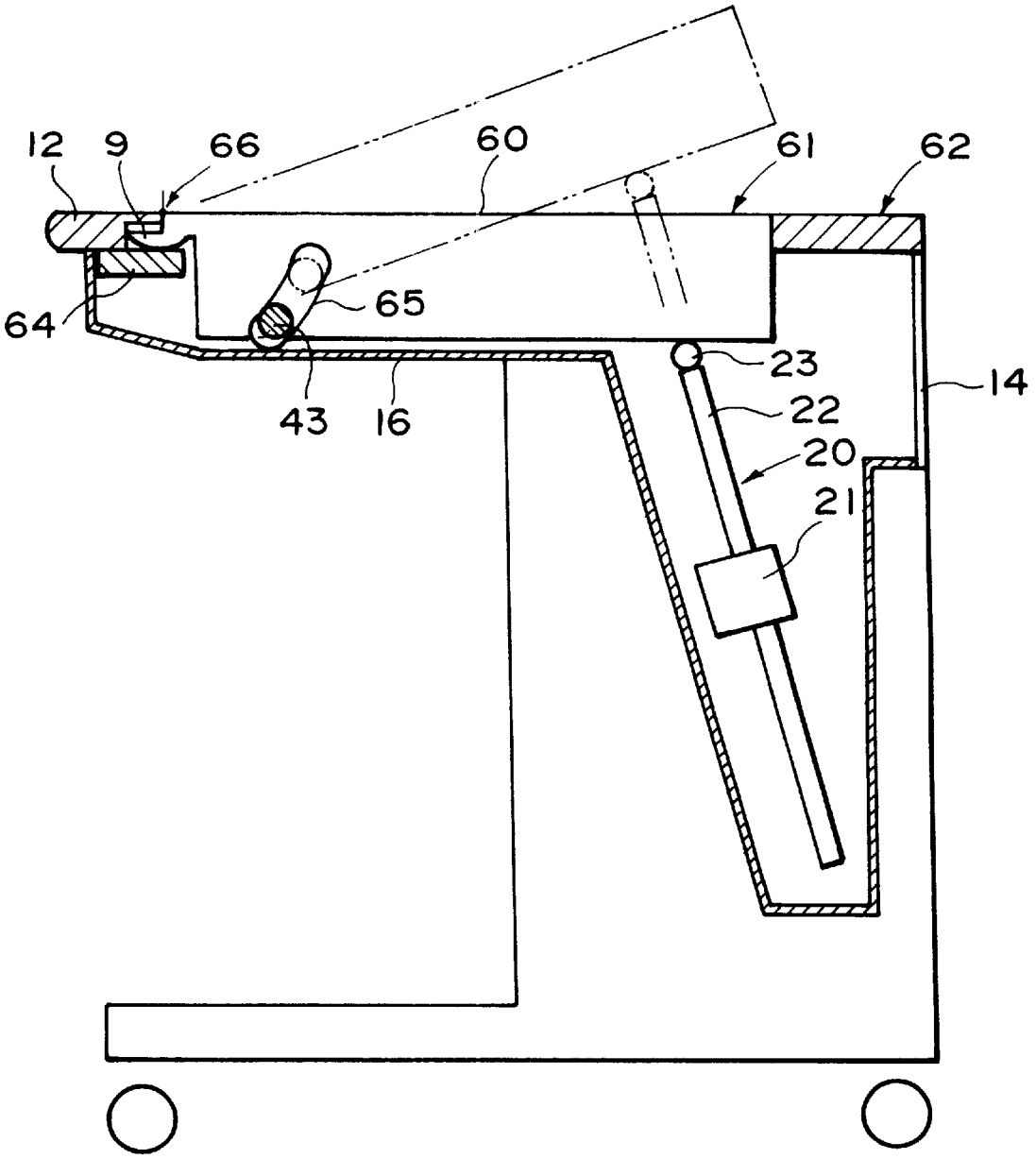
FIG. 14 is a schematic side sectional view of another embodiment.

Another embodiment regarding the tilt mechanism will now be described. FIG. 14 shows an example. Rollers 63 are provided on both of the right and left side surfaces of a casing of an information apparatus 61. The rollers 63 are urged in the outside direction of the casing by elastic members (not shown), respectively. The rollers 63 are constructed so that they can be retained in the casing by the operation of levers or the like (not shown). An arc-shaped receiving portion 64 having a flat surface portion on the lower side from one point (virtual axis) 66 on the ridge line 60 on the front side of the hole portion 12*a* of the top plate 12 by a distance corresponding to the radius of the arc-shaped portion 9 is provided in an information apparatus installing desk 62. Cam grooves 65 are formed on the right and left edge surfaces of the hole portion 12*a* around the virtual axis 66 as a center.

An attaching state of the information apparatus 61 to the desk 62 and the tilt operation will now be described. When attaching, the arc-shaped portion 9 of the information apparatus 61 is located on the flat surface of the arc-shaped receiving portion 15 of the desk 62 and the right and left rollers 63 are fitted into the right and left cam grooves 65. In a state in which the rollers 63 are retained in the casing, by operating a lever or the like (not shown) by the operator, the information apparatus 61 is attached to the desk 62 from the oblique upward direction of the top plate 12 and, after that, by operating the lever or the like (not shown), the retain of the rollers 63 is cancelled, thereby performing such an attaching operation. By operating the tilt mechanism portion 20, the rollers 63 are moved along the cam grooves 65, so that the information apparatus 61 is rotated around the virtual axis as a center and is tilted.

The construction other than the above structure is substantially the same as that in the first embodiment and its description is omitted.

In the embodiment as well, no stairway portion occurs between the upper surface of the casing 2 and the surface on the front side (operator side) than the virtual axis of the upper surface of the top plate 12 irrespective of the tilt angle, the arms can be stabilized, and the smooth inputting operation can be performed for a long time.

Figure 15:
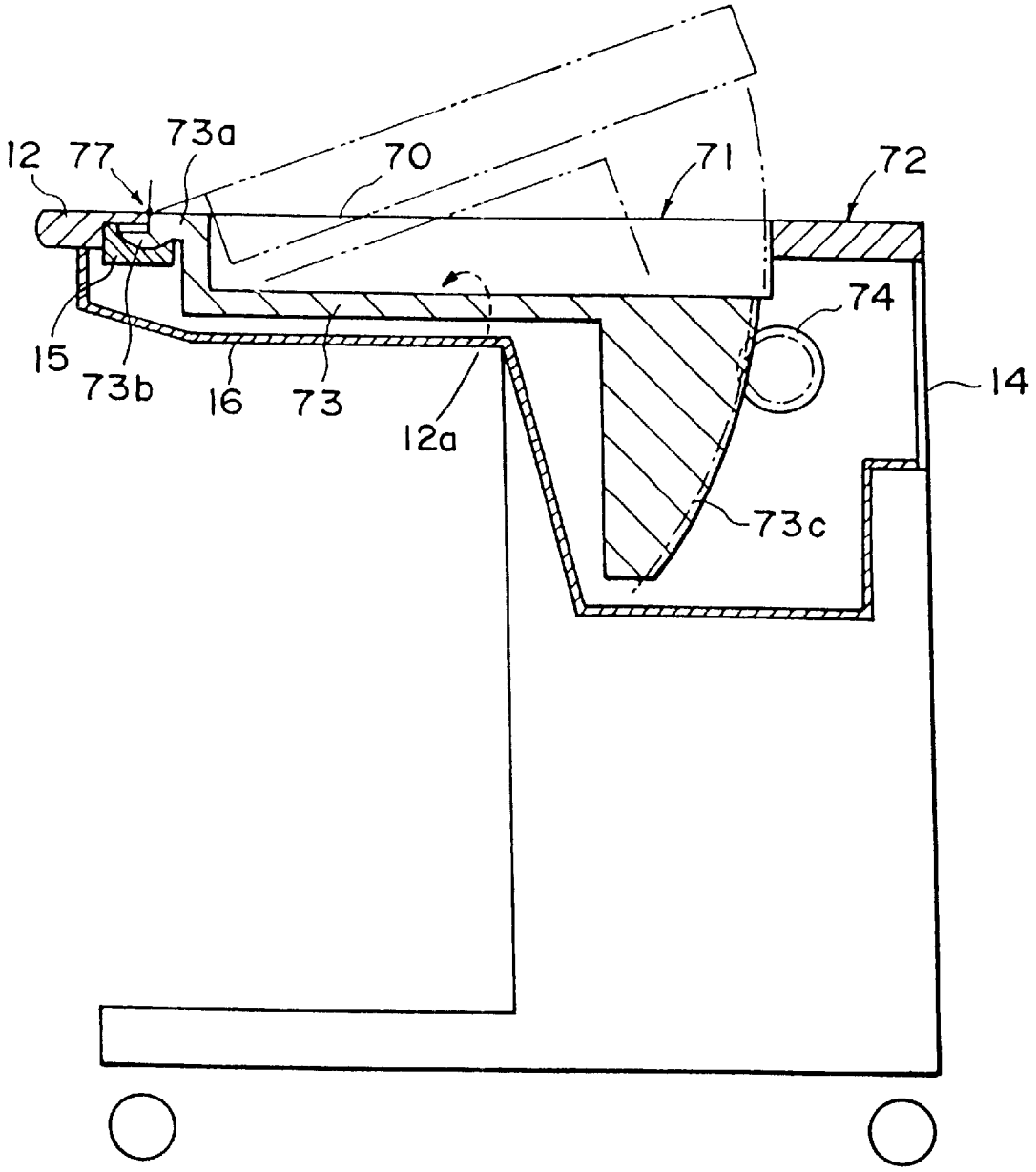
FIG. 15 is a schematic side sectional view of another embodiment.

Further another embodiment of an information apparatus and an information apparatus installing desk including a tilt mechanism portion will now be described. FIG. 15 shows a side sectional view.

In the diagram, an information apparatus 71 has a casing of an almost rectangular parallelepiped shape. An installing base plate 73 to install the information apparatus 71 is provided for a desk 72. A convex portion 73*a* having a stairway portion of a thickness of the information apparatus 71 is provided on the front side of the installing base plate 73. An arc-shaped portion 73*b* in which one point (virtual axis) 77 on a ridge line 70 on the front side of the hole portion 12*a* of the desk is set to a center is provided for the convex portion 73*a*. The arc-shaped receiving portion 15 for fitting and supporting the arc-shaped portion 73*b* is also provided. Further, a gear 73*c* of a fan shape is provided on the rear side of the installing base plate 73. A motor having a pinion 74 adapted to come into engagement with the gear 73*c* is provided. The construction other than the above structure is substantially the same as that in the first embodiment and its description is omitted.

In the above construction, in a state in which the information apparatus 71 is installed on the installing base plate 73 and the information apparatus 71 is enclosed in the desk 72, the upper surface of the top plate 12, the upper surface of the convex portion 73*a*, and the upper surface of the information apparatus 71 are set to almost the same plane. By operating an elevation switch (not shown), the motor is driven, the gear 73*c* is rotated by the pinion 74, and the installing base plate 73 is vertically rotated around the virtual axis as a center. Thus, the information apparatus 71 installed on the installing base plate 73 is tilted.

In the embodiment as well, no stairway portion occurs among the upper surface of the casing of the information apparatus 71, the upper surface of the convex portion 73*a*, and the surface on the front side (operator side) than the virtual axis of the upper surface of the top plate 12 irrespective of the tilt angle. The arms can be stabilized and the smooth inputting operation can be performed for a long time. In the embodiment, by merely putting the information apparatus 71 onto the installing base plate 73 from the upper direction of the desk 72, the apparatus 71 can be set onto the desk 72. The information apparatus 71 can be fairly easily attached and removed to/from the desk. Further, a projecting portion such as an arc-shaped portion or the like doesn't exist on the casing of the information apparatus 71 and an extremely excellent portability is derived. In the embodiment, by providing an enough thickness of the installing base plate 73, even in a tilted state of the information apparatus 71, the hole portion 12*a* cannot be seen from the directions of both of the right and left side surfaces. Namely, there is no inconvenience such that the pen or the like drops into the hole portion 12*a* or the like.

In the embodiment, although the shape of the casing of the information apparatus has been set to an almost rectangular parallelepiped shape, the invention is not limited to such a shape. So long as a shape which assures a ridge line serving as a virtual axis, any one of the semicircular shape and the like can be also used as a flat surface shape of the casing.

In the case where the arc-shaped portion of the information apparatus becomes an obstacle when the apparatus is carried, it is also possible to construct in a manner such that the arc-shaped portion is enclosed in the casing by a rotating mechanism, a slide mechanism, or the like.

The construction of the tilt mechanism portion is not limited to that in the above embodiment so long as the information apparatus is rotated around the virtual axis as a center. For example, it is also possible to use any one of the foregoing construction comprising the cam grooves, rollers, motor, and gear, a construction comprising a motor and a ball screw and using a linear motion, a construction which has a closable stand and in which the position of the stand is manually adjusted, and the like.

The system of the coordinate input means of the invention is not limited to the resistive film system of the above embodiments. The invention can be also applied to any one of the electromagnetic inductive system, ultrasonic wave using system, electrostatic coupling system, and the like. The system of the display means is also not limited to that in the above embodiments. Further, although the pen-shaped device has been used as a coordinate indicating device in the above embodiments, so called a mouse-shaped coordinate indicating device can be also used.

Although the arc-shaped portion and the arc-shaped receiving portion have been provided along the virtual axis in the above embodiments, the invention is not limited to such a structure. For example, it is also possible to use any one of the arrangement such that they are provided on only both of the right and left sides of the virtual axis, the construction such that they are arranged at a plurality of positions at predetermined intervals along the virtual axis, and the like. Further, they can be also arranged so as to protrude from the side surfaces to the right and left side surfaces of the casing.

What is claimed is:

1. A desk capable of installing an information apparatus having an arc-shaped portion, with a center of the arc providing a rotational center axis of the information apparatus, comprising:

a frame;

a top plate supported on said frame and having i) a cavity for receiving the information apparatus, said top plate having a top surface edge capable of coaxial alignment with the rotational center axis, and ii) a recess having, under part of said top plate, a corresponding arc-shaped surface capable of receiving at least part of the arc-shaped portion of the information apparatus, so that a top surface of said top plate can approximately contact and be flush with a top surface of the information apparatus on completely receiving the information apparatus and the information apparatus can be rotated about the rotational center axis of the arc-shaped portion; and a tilt mechanism supported in said frame and capable of rotating the information apparatus about the rotational center axis of the arc-shaped portion.

2. A desk according to claim 1, further having a second information apparatus enclosing portion.

3. A desk according to claim 1, wherein said tilt mechanism includes an arc-shaped receiving portion for supporting the arc-shaped portion of the information apparatus, and a slide mechanism housed in said frame for vertically moving a bottom surface of the information apparatus.

4. A desk according to claim 3, wherein said tilt mechanism further includes a rotating mechanism in place of said slide mechanism in which a virtual axis is set to a center.

5. A desk according to claim 4, wherein said tilt mechanism further includes a cam portion in which a ridge line on said to plate is set to a center.

6. A desk according to claim 3, wherein said tilt mechanism further includes a cam portion in which a ridge line on said top plate is set to a center.

7. A desk according to claim 1, wherein a connecting port for an electrical cord is provided in a bottom portion of the information apparatus.

8. A desk according to claim 1, wherein said top plate receives an information apparatus that includes output means for outputting information in place of the input means.

9. A desk according to claim 1, wherein said top plate receives an information apparatus that includes output means.

10. A desk according to claim 1, wherein a hole is formed in said top plate in place of the cavity and receives the information apparatus.

11. A desk with a rotatable portion, comprising:

a frame;

a top platform supported on said frame, said platform including peripheral edges and a cavity defined by interior edges;

a rotatable portion received within said cavity and rotatable about an axis which substantially coincides with an upper edge of the cavity;

a support for rotatably supporting said portion within the cavity such that an upper edge of said portion abuts said upper edge of the cavity, wherein a) in a first position a top surface of said portion is substantially flush with said top platform, and b) in a second position said portion is tilted with respect to said platform and substantially no gap exists between said upper edge of the cavity and said upper edge of said portion; and a tilting mechanism for rotating said portion about the rotatable axis between the first and second positions.

12. A desk according to claim 11, wherein said top platform includes a resting area between said interior edge proximate to the rotatable axis and said peripheral edges.

13. A desk according to claim 11, wherein said rotatable portion is part of an information apparatus.

14. A desk according to claim 11, wherein said tilt mechanism includes an arc-shaped receiver portion for supporting said portion, and a slide mechanism housed in said frame for vertically moving a bottom surface of said portion.

15. A desk according to claim 14, wherein said tilt mechanism further includes a rotating mechanism in place of said slide mechanism, in which a virtual axis is set to a center.

16. A desk according to claim 15, wherein said tilt mechanism further includes a cam portion in which a ridge line is set to a center.

17. A desk according to claim 14, wherein said tilt mechanism further includes a cam portion in which a ridge line is set to a center.

* * * * *

UNITED STATES PATENT AND TRADEMARK OFFICE

CERTIFICATE OF CORRECTION

PATENT NO. : 6,237,507 B1
APPLICATION NO. : 08/645568
DATED : May 29, 2001
INVENTOR(S) : Ryozo Yanagisawa et al.

It is certified that error appears in the above-identified patent and that said Letters Patent is hereby corrected as shown below:

COLUMN 15:

Line 34, “a” (second occurrence) should read --the--, and “on” should be deleted.
Line 35, “said to plate” should be deleted.
Line 37, “a” (second occurrence) should read --the--, and “on” should be deleted.
Line 38, “said top plate” should be deleted.

Signed and Sealed this

Fourth Day of March, 2008

JON W. DUDAS
*Director of the United States Patent and Trademark Office*